United States Patent [19]

Caslow et al.

[11] 4,245,969

[45] Jan. 20, 1981

[54] PUMP

[75] Inventors: Joseph H. Caslow, Deerfield Beach; Lyston C. Jennings, Lighthouse Point, both of Fla.

[73] Assignee: The Garrett Corporation, Los Angeles, Calif.

[21] Appl. No.: 6,623

[22] Filed: Jan. 26, 1979

[51] Int. Cl.[3] ..... F04C 2/18; F04C 15/00

[52] U.S. Cl. ..... 418/132; 418/135; 29/156.4 R

[58] Field of Search ..... 418/131, 132, 135, 1; 29/156.4 R

[56] References Cited

U.S. PATENT DOCUMENTS

| | | | |
|---|---|---|---|
| 2,969,744 | 1/1961 | Hoffer | 418/132 |
| 3,292,551 | 12/1966 | Gordon | 418/132 |
| 3,474,736 | 10/1969 | Lauck | 418/135 |

FOREIGN PATENT DOCUMENTS

| | | | |
|---|---|---|---|
| 1306005 | 9/1962 | France | 418/131 |
| 383880 | 5/1973 | U.S.S.R. | 418/131 |

*Primary Examiner*—John J. Vrablik

*Attorney, Agent, or Firm*—Albert J. Miller; Joel D. Talcott; Stuart O. Lowry

[57] ABSTRACT

A pump for pumping a fluid such as a fuel having poor lubricating qualities, comprising a matched set of pumping gears carried on rotatable shafts, with said shafts mounted for rotation within matched sets of floating bushings.

7 Claims, 4 Drawing Figures

PUMP

BACKGROUND OF THE INVENTION

This invention relates to fluid pumps. More specifically, this invention relates to a gear pump including a floating bushing arrangement enabling use of the gear pump for pumping a fuel with poor lubricating qualities at relatively high speeds and pressures.

Gear pumps in general are well known in the prior art, and typically comprise a matched set of meshing spur gears carried on parallel rotating shafts, and mounted in a generally figure-eight shaped chamber within a pump housing. The gears are rotated together to pump a fluid from a housing inlet port to an outlet port. Gear pumps of the prior art are most commonly used for pumping hydraulic fluids, such as oil, wherein inherent leakage within the housing is advantageously used to lubricate shaft bearings.

Gear pumps frequently are preferred over vane-type or reciprocating pumps because of their continuous flow capability, relatively accurate metering characteristics, and long term reliability. Moreover, gear pump output is relatively easily controlled by controlling the rotational speed of the pumping gears. However, the use of gear pumps has been limited in the prior art to relatively low speed and/or pressure pumping applications wherein the pumped fluid comprises a relatively viscous fluid, such as oil, satisfactory for lubricating the shaft bearings. Alternately stated, gear pumps have not been satisfactorily used for pumping fluids such as fuels at both high speeds and pressures wherein the fluid comprises a poor bearing lubricant. Instead, when poor lubricating fluids are pumped, the gear pump is operated at a relatively low speed to prolong bearing life, or is replaced in favor of a vane pump or the like capable of high speed operation and having independent bearing lubrication. However, vane-type pumps tend generally to be more expensive and less accurate than gear pumps, and are subject to premature failure due to high wear resulting from the required precise tolerances for satisfactory operation.

The prior art shows substantial effort relating to improvements in gear pump bearings and bearing lubrication. See, for example, U.S. Pat. No. 2,931,303 showing a fixed sleeve or bushing bearing arrangement. Other designs include axially floating, pressure loaded bearings such as those shown and described in U.S. Pat. Nos. 2,472,031; 2,527,941; 2,696,172; 2,870,718; and 3,003,425. Still other bearing designs include relatively expensive roller bearing systems such as those shown in U.S. Pat. Nos. 3,003,426, 3,083,645; and 3,203,355. However, none of the aforementioned bearing systems have been satisfactory for extended use in high speed fuel pumping applications, primarily because of bearing lubrication difficulties. This is particularly true wherein the pumped fuel comprises jet fuel or aviation gasoline, both of which are widely known as poor bearing lubricants.

The high speed pump of this invention overcomes the problems and disadvantages of the prior art by providing a gear pump having meshing pumping gears carried on rotatable shafts received in a bearing arrangement including axially and rotationally floating bushings designed for use under high speed, high pressure pumping conditions with poor lubricant fluids such as jet fuel and aviation gasoline.

SUMMARY OF THE INVENTION

In accordance with the invention, a gear pump for pumping fluids having poor lubricating qualities comprises a pair of matched pumping gears positioned in aligned meshing relation within a generally figure-eight shaped chamber of a pump housing. The pumping gears are carried on individual shafts, each having front and rear ends, with the front end of one shaft extending outwardly through a front wall of the housing for connection to suitable driving means. When the shaft is driven, the pumping gears are simultaneously rotated to pick up fluid such as fuel via an inlet port, and discharge the fluid under pressure through an outlet port.

The pumping gear shafts are carried within a bearing arrangement comprising matched sets of floating bushings. More specifically, the rear ends of the shafts are rotationally supported within individual, axially floating one-piece bushings interposed between the gears and a rear wall of the housing. These one-piece or rear bushings are secured within the housing against rotation as by matingly engaging discontinuous or flattened surfaces, and are axially pre-loaded toward the gears as by spring means between said bushings and the housing rear wall.

The front ends of the shafts are rotationally supported within a pair of three-piece bushing assemblies. The bushing assemblies each include a thrust bushing axially retained adjacent tthe associated pumping gear by a retainer bushing which is in turn axially secured against a shoulder on the front wall of the housing. The thrust and retainer bushings of each bushing assembly are secured against rotation as by matingly engaging discontinuous or flattened surfaces. Each retainer bushing rotationally receives an axially and rotationally floating journal bushing received over the associated gear shaft, and which rotationally floats during pump operation at roughly one-half the rotational speed of the shaft.

BRIEF DESCRIPTION OF THE DRAWINGS

The accompanying drawings illustrate the invention. In such drawings.

DETAILED DESCRIPTION OF THE PREFERRED EMBODIMENT

Figure 1:
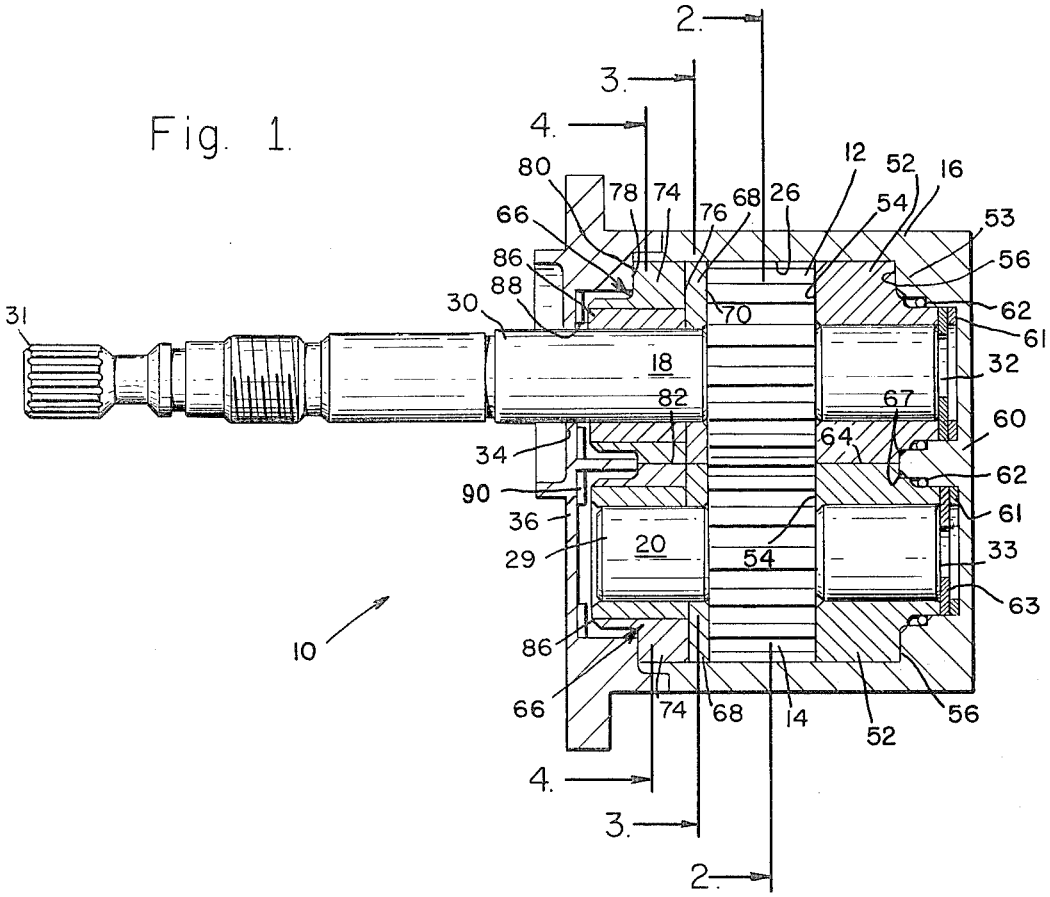
FIG. 1 comprises a section of a gear pump of this invention.

A pump 10 of this invention is shown in FIG. 1, and generally comprises a gear pump including a matched pair of pumping gears 12 and 14 carried within a gear pump housing 16. The pumping gear 12 comprises a spur gear carried upon a driving shaft 18, and the gear 14 comprises a complementary spur gear carried on a driven or idler shaft 20. The driving and driven shafts 18 and 20 are mounted within the housing 16, with their respective pumping gears 12 and 14 meshing together. Accordingly, rotational movement of the driving shaft 18 rotationally drives the gears 12 and 14 to pump fluid, as will be hereafter described in more detail. Importantly, both of the shafts 18 and 20 are rotationally supported within the pump housing by axially and rotationally floating bearings.

Figure 2:
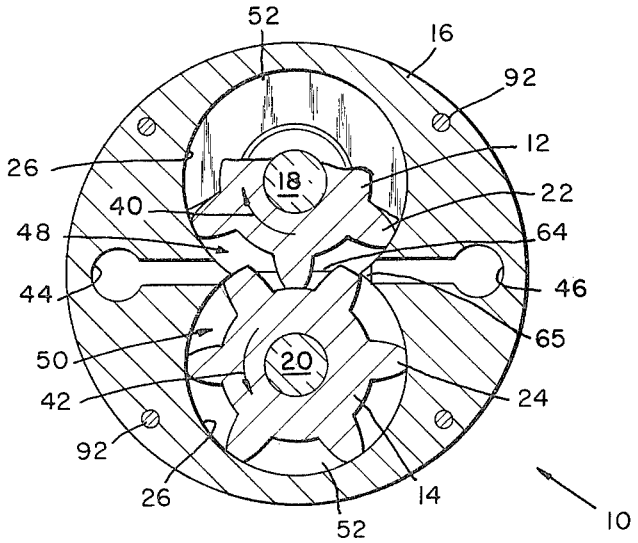
FIG. 2 comprises a section taken on the line 2—2 of FIG. 1, with portions broken away.

As shown in FIGS. 1 and 2, the pumping gears 12 and 14 are carried within the housing 16 generally in a common plane with their respective spur teeth 22 and 24 meshing together. The gears 12 and 14 are positioned within slightly overlapping cylindrical chambers which combine to define a chamber 26 having a generally figure-eight configuration. As shown, the gear 12 is positioned in the upper portion of this chamber 26 and is machined as an integral part of the driving shaft 18. The driving shaft 18 extends axially with respect to the gear 12, and includes a front end 30 and a rear end 32. The front end 30 of the shaft 18 projects axially from the gear 12 through an aligned opening 34 in a front wall 36 of the housing 16. This projecting front end 30 of the shaft 18 may be conveniently coupled as by a spline 31 to a suitable power source (not shown) for rotatably driving the shaft 18 and thereby operating the gear pump 10.

The mating pumping gear 14 is positioned in the lower portion, as shown in the drawings, of the housing chamber 26. This gear 14 is also integral with its respective shaft 20, with the shaft 20 extending axially with respect to the gear 14 and having front and rear ends 29 and 33. Thus, as shown best in FIG. 2, clockwise rotation of the driving shaft 18 correspondingly drives the pumping gear 12 in a clockwise direction as illustrated by arrow 40, and drives the gear 14 and driven shaft 20 in a counterclockwise direction as illustrated by arrow 42.

The rotational movement of the pumping gears 12 and 14 serves to pump fluid from an inlet port 44 to an outlet port 46. More specifically, as illustrated in FIG. 2, the pump housing 16 includes an inlet port 44 opening into the housing chamber 26 generally at one side of the intersecting gear teeth 22 and 24. This inlet port 44 is adapted for connection to a suitable supply of fluid such as fuel so that the rotating pumping gears 12 and 14 may draw in and pump said fluid. That is, as the pumping gears 12 and 14 are rotationally driven as indicated by arrows 40 and 42, fluid is captured in spaces 48 and 50, respectively, between the spur teeth 22 and 24 on the gears. This fluid is rotationally swept by the teeth 22 and 24 in the directions of the arrows 40 and 42 for discharge from the pump housing under pressure via the outlet port 46. As shown, this outlet port 46 opens into the housing chamber 26 generally at the side of the intersecting gear teeth 22 and 24 opposite the inlet port 44, and is adapted for coupling to a suitable fluid load.

The driving and driven shafts 18 and 20 are rotationally supported by matched sets of bearings including axially and rotationally floating bushings. More specifically, as shown in FIGS. 1 and 2, the rear ends 32 and 33 of the driving and driven shafts 18 and 20 are respectively received in complementary-shaped, one-piece rear bushings 52. These rear bushings 52 are each formed from a suitable bearing material such as a carbon or bronze material, and provide combined thrust and journal bearings for the rear ends 32 and 33 of the shafts. Each of the rear bushings 52 includes a thrust face 54 abuttingly contacting the rear face of the adjacent pumping gear, and a plurality of radially inwardly stepped shoulders 56 opposite the thrust face 54. These shoulders 56 cooperate with complementary-shaped shoulders 53 on the rear wall 60 of the housing 16 to axially position the bushings 52, and to entrap one or more fluid seals 62, such as O-rings, between the rear wall 60 and the bushings 52 to prevent fluid leakage.

The axial lengths of the rear bushings 52 are chosen to allow interposition of washer-shaped springs 61 between each bushing 52 and the housing rear wall 60. Conveniently, each of these springs 61 reacts between the wall 60 and a flat washer 63 which in turn bears against the associated bushing 52. With this construction, the rear bushings 52 are axially biased or preloaded toward the pumping gears 12 and 14. This assures that the rear bushings 52 are properly aligned against the adjacent pumping gears 12 and 14 upon start-up of pump operation. After initial start-up, the pumped fluid sets up hydrodynamic lubricanting films between the bushings and the gears to properly lubricate the bushings. Moreover, during operation, a small quantity of pressurized fluid from the outlet port 46 is supplied through a slot 65 (FIG. 2) in the housing 16 to the rear sides of the bushings 52 to dynamically pressure-load the bushings. Specifically, the fluid in the slot 65 is supplied to a chamber 67 (FIG. 1) formed by a recessed portion of the housing shoulders 53, and thereby reacts between the housing rear wall 60 and the rear bushings 52 to help retain the bushings in running alignment with the pumping gears 12 and 14.

Figure 3:
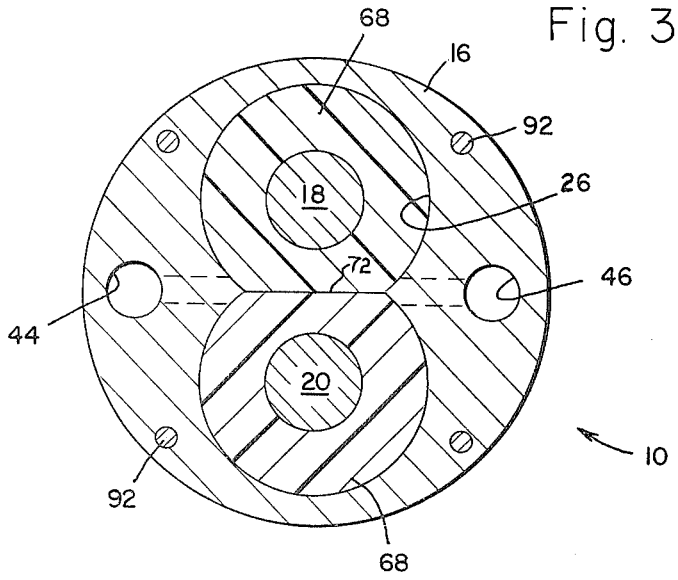
FIG. 3 comprises a section taken on the line 3—3 of FIG. 1.

The peripheral contour of the matched one-piece rear bushings 52 closely conforms to the shape of the figure-eight shaped housing chamber 26, as shown in FIG. 3. With this configuration, substantial fluid leakage around the bushings 52 is prevented. Moreover, the rear bushings 52 include discontinuous or flattened peripheral faces 64 which matingly engage each other adjacent the intersection of the meshing gear teeth 22 and 24. These matingly engaging flattened faces 64 serve to prevent the bushings 52 from rotating within the housing 16, and thereby prevent rotational floating of the bushings 52.

Figure 4:
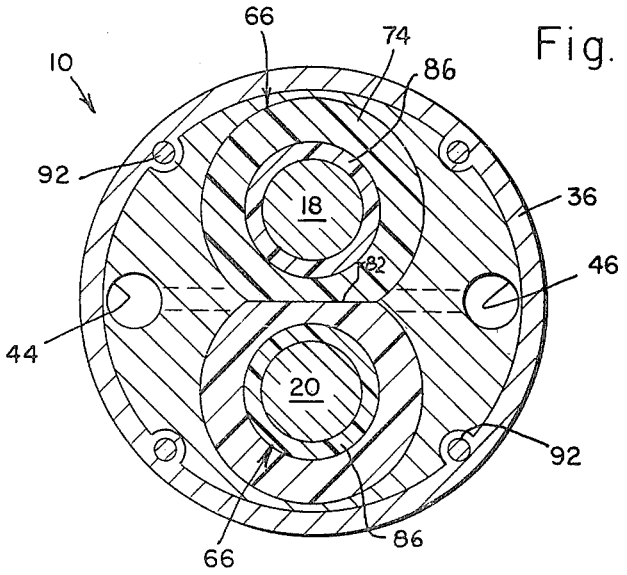
FIG. 4 comprises a section taken on the line 4—4 of FIG. 1.

The front ends 30 and 29 of the driving and driven shafts 18 and 20 are rotationally supported by complementary-shaped three-piece bushing assemblies 66. As shown in FIGS. 1, 3, and 4, these bushings assemblies each include a thrust bushing 68 having a thrust face 70 in running engagement with the adjacent pumping gear. The thrust bushings 68 are formed from a suitable bearing material such as carbon or bronze, and, like the one-piece bushings 52, are complementary-shaped to closely correspond to the peripheral contour of the chamber 26. Thus, the thrust bearings 68 include matingly engaging discontinuous or flattened surfaces 72 adjacent the intersection of the gear teeth 22 and 24 to fix the thrust bushings 68 against rotational floating.

The thrust bushings 68 are retained in abutting engagement with the pumping gears 12 and 14 by a pair of complementary-shaped retainer bushings 74. These retainer bushings 74 are also formed from a suitable bearing material, and each includes a flat rear face 76 bearing against the adjacent thrust bushing 68. From the rear face 76, each retainer bushing 74 extends axially forwardly and includes a radially inwardly stepped shoulder 78 in bearing engagement with an aligned shoulder 80 on the housing 16. With this construction, the retainer bushings 74 serve to axially space the thrust bushings 68 and the pumping gears 12 and 14 with respect to the front wall 36 of the housing 16. Importantly, the pressure-loaded one-piece rear bushings 52 and the springs 61 on the opposite sides of the gears 12 and 14 function to bias the entire assembly forwardly with the retainer bushings 74 engaging the front shoulders 80 on the housing. Thus, during operation, the entire assembly is pressure-loaded by the springs 61 and fluid pressure within the pump for a controlled amount of axial floating in response to internal pump pressures during operation.

The retainer bushings 74 are also externally contoured to fit closely within the figure-eight shaped housing chamber 26. Thus, as shown in FIG. 4, these retainer bushings 74 also include discontinuous or flattened faces 82 which matingly engage each other to secure the bushings 74 against rotational floating.

The retainer bushings 74 are formed to have an inner diameter substantially larger than the outer diameter of the driving and driven shafts 18 and 20. This allows a floating sleeve bushing 86 to be concentrically received over each of the shafts 18 and 20 within each of the retainer bushings 74. These sleeve bushings 86 are also formed from a suitable bearing material such as carbon or bronze, and extend axially between the adjacent thrust bushing 68 and the front wall 36 of the housing 16. Importantly, the axial length of each sleeve bushing 86 is chosen to provide a slight axial space 88 between the sleeve bushing 86 and the front wall 36 so as to allow limited axial floating of the sleeve bushings 86. Conveniently, washer-like stops 90 are formed on the front wall 36 of the housing for contacting the floating sleeve bushings 86 during operation, and thereby help to prevent wear of the wall 36.

In operation, the driving shaft 18 is rotatably driven to drive the pumping gears 12 and 14 to pump fluid from the inlet port 44 to the outlet port 46. The one-piece rear bushings 52, the pumping gears 12 and 14, the thrust bushings 68, and the retainer bushings 74 are all axially pressure-loaded during operation by the springs 61 and discharge fluid pressure in the chambers 67 to maintain the components in running alignment, while at the same time allowing a controlled axial floating of the components to compensate for internal pump imbalances. Importantly, the sleeve bushings 86 freely float axially and rotationally with respect to the other components. That is, the sleeve bushings 86 float rotationally relative to their respective shafts 18 and 20, and relative to the retainer bushings 74. In practice, these sleeve bushings 86 rotate at roughly one-half the rotational speed of the shafts 18 and 20. Moreover, the sleeve bearings 86 float axially without pressure loading to further compensate for internal pump imbalances.

The pump 10 of this invention is particularly suited for use in pumping fluids having relatively poor lubricating qualities, such as fuels comprising jet fuel, aviation gasoline, and the like, at relatively high speeds and pressures. That is, in the prior art, high speed and high pressure pumping of fuels comprising poor lubricants by means of gear pumps has been avoided because of the inability of the fuels to properly lubricate the pump bearings during high speed operation. However, in the pump of this invention, it has been found that the axial floating nature of the various components, together with the axial and rotational floating of the sleeve bushings 86 sufficiently reduces bearing wear whereby these fluids may be pumped at high speeds and pressures. By way of specific example, the pump of this invention has demonstrated prolonged life operating capability in pumping jet fuel or aviation gasoline under starting conditions of over 700 R.P.M. at 250 p.s.i. and continuous operation of at least 6,000 R.P.M. at 1,500 p.s.i.

The pump 10 of this invention is quickly and easily assembled. That is, as shown in FIG. 1, the housing 16 may be formed from two parts, with the front wall 36 forming a cap for the entire assembly. The shoulders 53 on the housing rear wall 60 readily position the springs 61, washers 63, and O-ring seals 62 which may be dropped into position. Then, the gears 12 and 14 on the shafts 18 and 20 are inserted with the one-piece rear bushings 52 in place. The three-piece bushing assemblies 66 are then positioned over the shafts 18 and 20 after which the front wall 36 may be mounted in position as by bolts 92 or the like to enclose the chamber 26.

The pump 10 described herein may include various modifications and improvements without varying from the scope of the invention. Accordingly, no limitation of the invention is intended by way of the description of the preferred embodiment except as set forth in the appended claims.

What is claimed is:

1. A pump for pumping fluid having poor lubricating qualities comprising a pump housing having inlet and outlet ports; a driving shaft and a driven shaft each having front and rear ends within said housing, said driving shaft having its front end coupled to means for rotatably driving said driving shaft; a pair of pumping gears carried within said housing respectively on said shafts in meshing relation to move fluid between said inlet and outlet ports upon shaft rotation; a pair of substantially identical one-piece rear bushings received respectively over the rear ends of said shafts between said housing and gears, and including means for preventing rotation of said rear busings within said housing; a pair of substantially identical bushing assemblies received respectively over the front ends of said shafts between said housing and gears, said assemblies each including a thrust bushing received over the associated shaft in running alignment with the adjacent gear, a retainer bushing received over the associated shaft between the thrust bushing and housing, and an axially and rotationally floating sleeve bushing received concentrically between the retainer bushing and the associated shaft, said retainer and thrust bushings each including means for preventing rotation thereof within said housing; and means reacting solely between said housing and said rear bushings for axially pressure-loading said rear bushings, gears, thrust bushings, and retainer bushings in the same axial direction into running alignment with respect to each other and said housing.

2. A pump as set forth in claim 1 wherein said pressure-loading means comprises spring means between said rear bushings and said housing for substantially uniformly biasing said rear bushings axially toward said gears, whereby said gears are substantially uniformly biased into running engagement with said thrust and said retainer bushings.

3. A pump as set forth in claim 1 wherein said rear bushings include rearwardly presented shoulders and cooperate with said housing to form a chamber between said housing and said shoulders, and wherein said pressure-loading means comprises passage means formed in said housing between the outlet port and said chamber for supplying fuel under pressure to said chamber for substantially uniformly biasing said rear bushings toward said gears.

4. A pump as set forth in claim 1 wherein said housing has a generally figure-eight shaped chamber formed therein, said pairs of rear bushings, retainer bushings, and thrust bushings being formed for generally mating reception within said chamber to closely conform with the surface configuration thereof, and said rotation preventing means including matingly engaging discontinuous peripheral faces for locking the same against rotation within said housing.

5. A pump for pumping fuel having poor lubricating qualities, comprising a pump housing having a generally figure-eight shaped chamber formed therein, and including inlet and outlet fluid ports; a driving shaft and a driven shaft each having front and rear ends within said housing, said driving shaft having its front end coupled to means for rotatably driving said driving shaft; a pair of pumping gears carried within said housing respectively on said shafts in meshing relation to move fluid between said inlet and outlet ports; a pair of substantially identical one-piece rear bushings received respectively over the rear ends of said shafts, said rear bushings each including a generally circular periphery over a substantial portion of the periphery thereof and a flattened peripheral face, said pair of rear bushings being matingly received within said housing chamber with said flattened portions engaging each other for preventing rotation of said rear bushings within said housing; a pair of bushing assemblies received respectively over the front ends of said shafts between said housing and said gears, said assemblies each including a thrust bushing received over the associated shaft in running alignment with the adjacent gear, a retainer bushing received over the associate shaft between the thrust bushing and housing, and an axially and rotationally floating sleeve bushing received concentrically between the retainer bushing and the associated shaft, said retainer and thrust bushings each including a generally circular periphery over a substantial portion of the periphery thereof and a flattened peripheral face, said pairs of thrust and retainer bushings being matingly received within said housing chamber with their respective flattened portions engaging each other for preventing rotation of said thrust and retainer bushings within said housing; and means reacting solely between said housing and said rear bushings for axially pressure-loading said rear bushings, gears, thrust bushings, and retainer bushings into running alignment with respect to each other and said housing.

6. A method of making a pump for pumping a fluid having poor lubricating properties comprising the steps of mounting a pair of pumping gears in meshing relation on a pair of shafts having front and rear ends, and within a housing for movement of fluid between housing inlet and outlet ports upon shaft rotation; connecting driving means to the front end of one of the shafts for rotatably driving said one shaft; receiving the rear ends of the shafts respectively with a pair of axially floating and rotationally fixed one-piece rear bushings; receiving the front ends of the shafts respectively within a pair of bushing assemblies each including an axially floating and rotationally fixed thrust bushing received over the associated shaft in running alignment with the adjacent gear, an axially floating and rotationally fixed retainer bushing received over the associated shaft axially between the thrust bushing and housing, and a sleeve bushing concentrically between said retainer bushing and the associated shaft; and axially pressure-loading said rear bushings, gears, thrust bushings, and retainer bushings in the same axial direction into running alignment with respect to each other and said housing with substantially uniform axial forces and with means reacting solely between the housing and the rear bushings.

7. The method of claim 6 wherein said housing has a generally figure-eight shaped chamber formed therein, and including the step of forming said pair of rear bushings, retainer bushings, and thrust bushings for generally mating reception within said chamber to closely conform to the surface configuration thereof, and to include matingly engaging discontinuous peripheral faces for locking the same against rotation within said housing.

* * * * *